United States Patent [19]

Feenstra et al.

[11] Patent Number: 4,523,615

[45] Date of Patent: Jun. 18, 1985

[54] METHOD AND APPARATUS FOR IN SITU PURGING A XEROGRAPHIC DEVELOPER

[75] Inventors: David D. Feenstra, Larimer County; Robert L. Fey; Cheryl A. Goin, both of Longmont, all of Colo.

[73] Assignee: International Business Machines Corporation, Armonk, N.Y.

[21] Appl. No.: 476,005

[22] Filed: Mar. 17, 1983

[51] Int. Cl.[3] ..... B65B 1/06

[52] U.S. Cl. ..... 141/1; 141/98; 141/364; 206/525; 206/624; 206/628; 355/3 DD

[58] Field of Search ..... 53/449, 382, 381 A, 53/492; 206/624, 628, 494, 233, 525; 141/364, 1, 98, 325, 326, 327, 106, 369–381; 430/107; 355/3 DD

[56] References Cited

U.S. PATENT DOCUMENTS 3,326,364 6/1967 Waldrop et al. ..... 206/628

FOREIGN PATENT DOCUMENTS 56-168670 12/1981 Japan .
57-86875 5/1982 Japan .

*Primary Examiner*—Houston S. Bell, Jr.
*Attorney, Agent, or Firm*—Francis A. Sirr

[57] ABSTRACT

The developer station of a xerographic reproduction device is purged of used developer mix, and the developer is refilled with new mix, without disturbing the developer's operative position within the reproduction device. New mix is shipped from the factory in a sealed bag, protected by a unique, throw-away, rigid, corrugated paperboard, outer package. This package is opened at the location of the reproduction device to be serviced, and the sealed bag is removed. A tear strip on the side of the package is then removed, leaving an elongated opening along one side of the empty package. The package's shape is such that it can be inserted into the developer, with the package's elongated opening aligned with the developer's mix-flow path. Operation of the developer now fills the package with used mix. The package is then discarded. The sealed bag is opened, and the new mix is placed in the developer.

9 Claims, 8 Drawing Figures

METHOD AND APPARATUS FOR IN SITU PURGING A XEROGRAPHIC DEVELOPER

DESCRIPTION

1. Field of the Invention

This invention relates to xerography. More particularly, this invention relates to method and apparatus for removing used developer mix from a magnetic brush developer, prior to replacing the mix with a new, unused mixture.

2. Background of the Invention

Xerographic developer mix contains two constituents, toner and carrier beads. The beads act as triboelectric carrier for the toner. In the case of magnetic brush development, these beads are ferromagnetic, for example steel, so that magnetic conveying rollers, and magnetic brush rollers, can be used to transport the carrier/-toner to the photoconductor. At the photoconductor, some of the toner transfers from the carrier beads to the photoconductor's electrostatic image, to thereby develop or tone that image.

As toner is used up in the photoconductor development process, additional toner is metered into the developer. After many thousands of copies, the developer mix, and particularly the carrier beads, begin to degrade. When this occurs, substantially all of the developer mix must be removed from the developer, and new developer mix must be placed in the developer. This requires the services of a trained individual, for example, a customer engineer.

Replacing developer mix has been a time consuming and dirty task. Typically, the entire developer is removed from the machine. The customer engineer then holds the developer upside-down over a trash container, and dumps the old developer mix. The customer engineer performing this task must wear gloves, or be prepared to have his hands covered by black toner dust. Even if a vacuum cleaner is used, it is difficult to remove the old mix because the mix is electrostatically charged.

Another way to purge the developer mix involves sliding the developer out of the reproduction device, to thereby expose the magnetic brush roller. The magnetic brush is exposed by sliding the developer, cantilever-fashion, on rails, out of the side of the copier or printer. A one-piece scraping blade, and a catching container, are then held against the surface of the magnetic brush roller. A manual handle allows the customer engineer to manually rotate the brush roller's internal magnetics. As the magnets rotate within the roller, the developer mix walks around the surface of the roller, and is scraped off by the scraping blade, where it then drops into the catching container.

In situ techniques for purging developer mix are shown in Japanese Publication Nos. 56-168670 (application No. 55-186649, application date Dec. 27, 1980, Japan) and 57-86875 (application No. 55-162547, application date Nov. 20, 1980, Japan) respectively. These techniques consist essentially of opening an exposed wall of the developer and attaching a catching container to the opening. Once the catcher is attached, a lever is rotated, causing a deflector to enter the developer, to intercept the mix-flow path within the developer. Now, as the developer is operated, the deflector intercepts the mix and deflects it into the catcher, where it can be removed.

It is also known that a commercial xerographic laser printer, known as the IBM 3800, provides a means for in situ replacement of spent developer mix. In this device, a bottom-disposed dump chamber is normally sealed from the developer's mix sump. When it becomes necessary to replace spent developer mix, a door is manually opened, allowing the sump's mix to gravity-fall into this chamber. A flexible hose leads from this chamber to a throw-away box. A hand crank is now operated to purge the sump of the majority of its mix. Thereafter, the developer is machine-driven, to purge the developer of the remaining mix. The door is then closed, new mix is poured into the developer sump, and the old mix is discarded.

While prior art in situ techniques are cleaner than manually removing the developer and dumping the developer mix, expensive additional hardware must be provided in each and every reproduction device.

SUMMARY OF THE INVENTION

The present invention provides a shipping container, or overpack, for a sealed, plastic bag of new developer mix (i.e., toner and carrier). This overpack is made of corrugated paperboard, sometimes called cardboard or fiberboard. The overpack is manufactured in a collapsed state, for convenience of storage and shipping. When put in use, the overpack is unfolded, to form an elongated box, of rectangular cross section, about 14 inches long, 3 inches wide, and 6 inches high. One $3\times6$ end is closed and taped shut. An empty plastic bag is inserted into the open $3\times6$ end, and this bag is filled with new developer mix, as the overpack stands on its sealed end. The plastic bag conforms to the inner shape of the overpack. After the bag is filled, the bag is sealed, followed by sealing of the remaining $3\times6$ open end of the overpack.

The protected plastic bag of developer mix is now ready for storage. Later, it is shipped to the location of a reproduction device (copier or printer) which requires service by service personnel, such as a customer engineer.

When the customer engineer receives this product, the top, $3\times14$ flap of the overpack is opened, and the sealed bag of developer mix is removed. Next, an elongated, perforated tear strip is removed from a $6\times14$ side of the overpack, leaving an opening, about $1\times12$ inches, the long dimension of which is generally parallel to the overpack's top flap.

Next, the customer engineer removes a hardware portion of the developer, for example the developer's toner dispenser unit. This leaves a top-disposed opening in the developer. The now-empty overpack is inserted into this opening, while the bulk of the developer hardware remains, in situ, in its operating position. In this position, the overpack's elongated opening is aligned with the developer's mix-flow path. The developer is now machine-powered. This operation causes the old developer mix to flow into the overpack, through this $1\times12$-inch opening.

When the developer has been purged of old mix, the overpack is removed, placed in an empty plastic bag, and discarded. Depending upon the size of the overpack, and placement of its tear strip, it may be necessary to empty the overpack of used mix a number of times before the developer is entirely purged of used developer mix. The bag containing new mix is now opened, and is poured into the developer through the same top-disposed opening that was used to purge the developer of the old mix.

In this way, double-use of the overpack, for shipment, and as a developer mix removal tool, avoids the necessity for the customer engineer to remove and readjust the developer's position, to carry a special, reusable tool, or to clean such a tool after each use. Since mix replacement (sometimes called recharging) usually occurs in an office environment, the need for a quick, clean method and apparatus to purge a xerographic developer, which does not require developer readjustment, is self evident.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
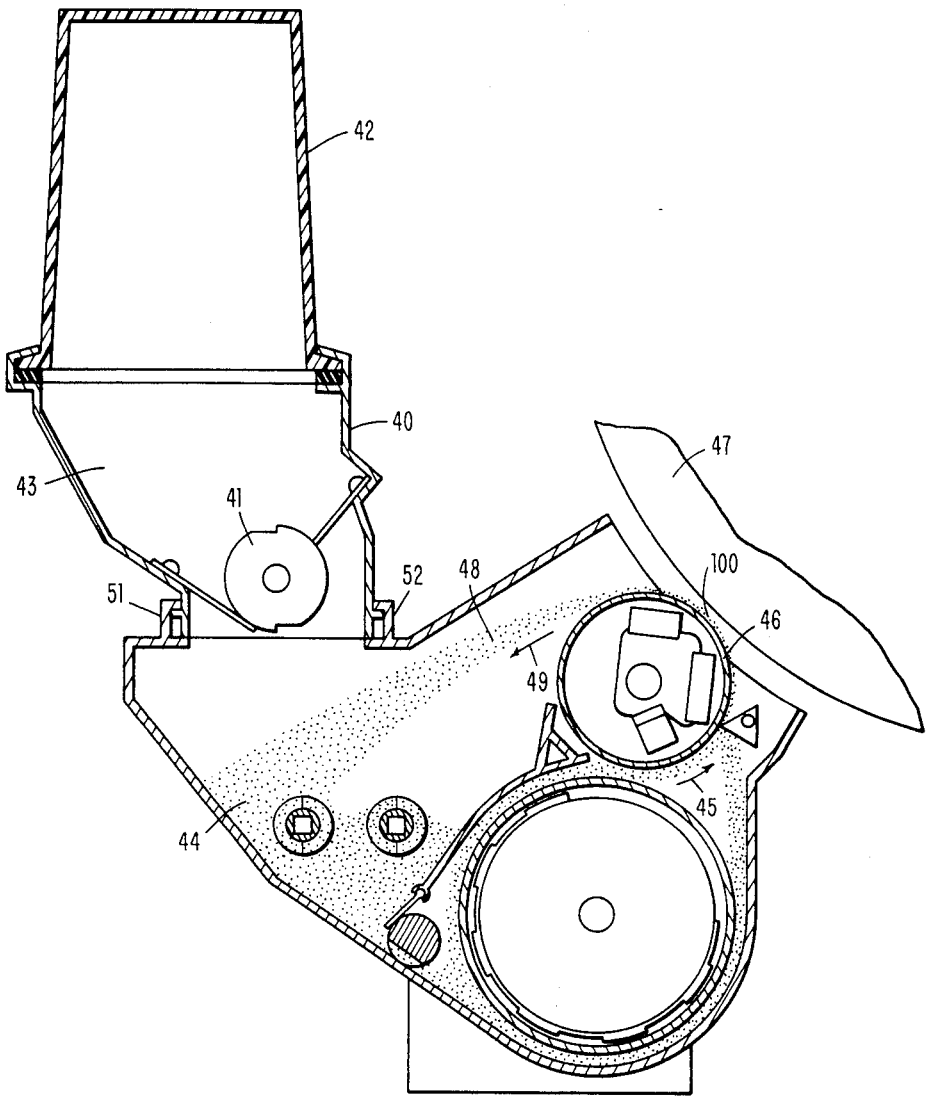
FIG. 1 PRIOR ART
FIGS. 1 and 2 are a side view and a perspective view, respectively, of a prior art xerographic developer station useful with the present invention.
Figure 2:
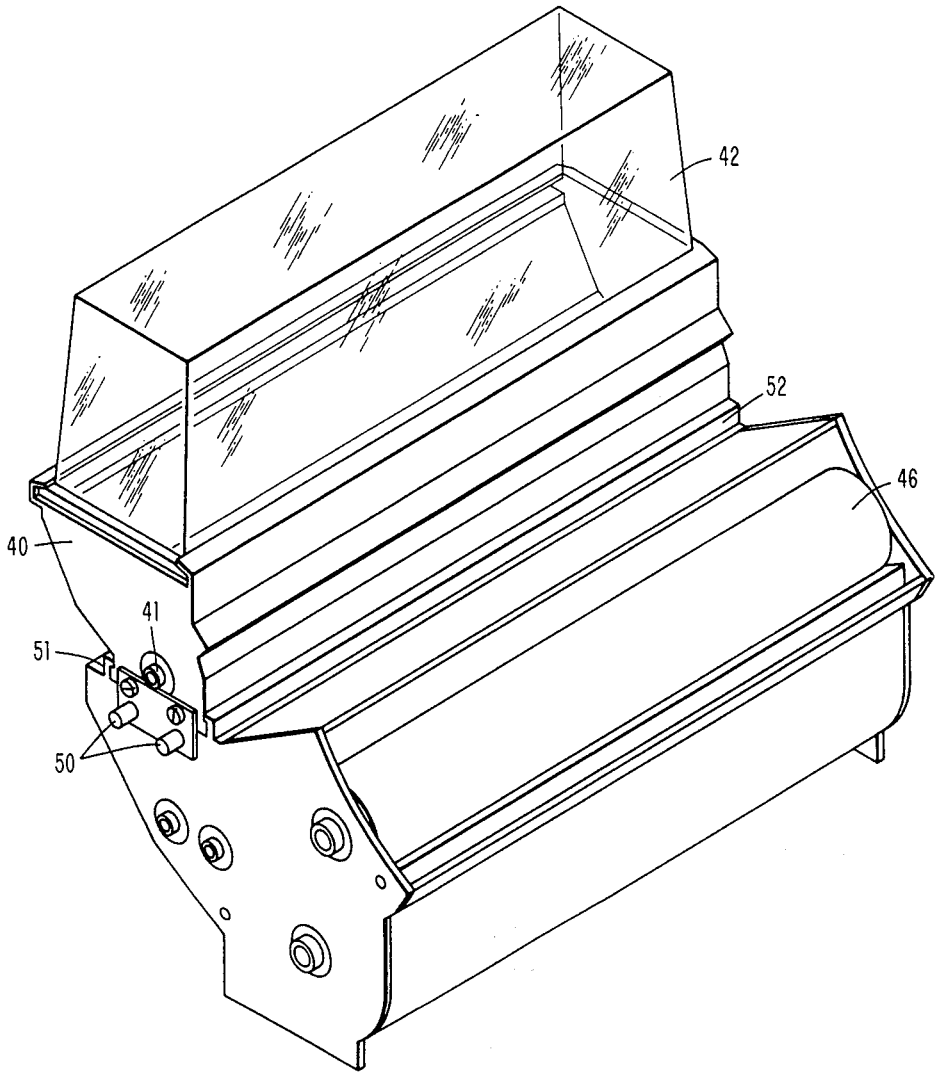
FIG. 2 PRIOR ART
Figure 3:
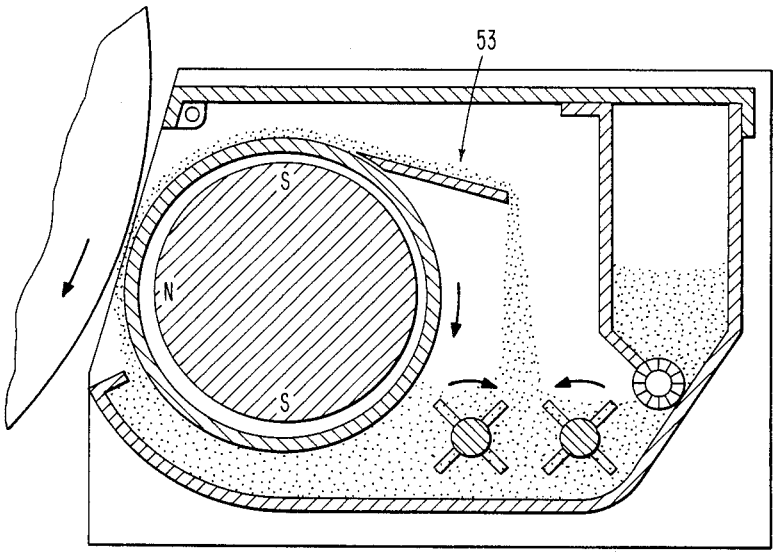
FIG. 3 PRIOR ART
FIGS. 3 and 4 are views of two other general types of prior art developer stations useful with the present invention.
Figure 4:
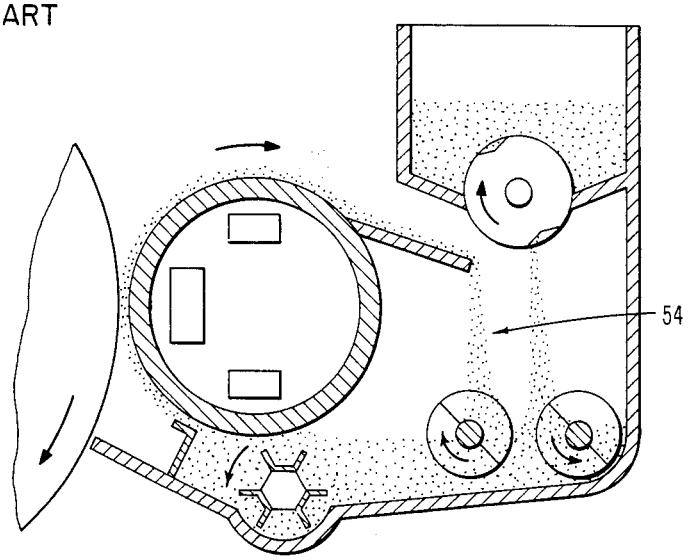
FIG. 4 PRIOR ART

This invention is not to be limited to a particular xerographic developer configuration. Good practice in the xerographic art requires that virgin toner be dispensed, as needed, into the developer's mix flow path, and preferably at a point in the flow path immediately downstream of the developing nip. It is at this point that the carrier beads are the most depleted of toner particles. The developer station shown in FIGS. 1 and 2 is of the general type used in the IBM Series III Copier/Duplicator. FIGS. 3 and 4 show yet further developer configurations which are usable with the present invention.

The common feature of these developers is that removal of the developer's toner dispensing unit leaves an opening into which the double-use, disposable container of the present invention may be inserted. The container's shape, and the shape and location of the container's tear strip, is modified, in accordance with the present invention, so that the container fits into this opening in the developer, with the slit which is left by removal of the tear strip being properly positioned to intercept the developer's mix-flow path.

THE INVENTION

With reference to FIG. 1, this magnetic brush developer (also see FIG. 2) includes a virgin-toner dispenser 40 whose metering roller 41 rotates in order to dispense toner from cartridge 42 and compartment 43 into developer sump 44.

The construction and arrangement of developer stations useful with the present invention is quite general. This particular developer presents developer mix (see arrow 45) to development nip 100 (i.e., at the confluence of circular-cylinder magnetic brush roller 46 and circular-cylinder photoconductor drum 47). Toner is depleted from the mix at this nip, and the depleted mix then returns to sump 44 by way of flow-path 48 (see arrow 49).

Within the teachings of the present invention, developer mix is purged from the developer by first removing dispenser 40. Such removal is facilitated by operation of fasteners 50 (FIG. 2), whereupon the dispenser can be manually moved (on guides 51 and 52, FIG. 1) out of the front of the xerographic device (i.e., to the left as shown in FIG. 2).

Placement of the combined shipping container/mix removal tool of this invention, so as to intercept mix-flow 48, now facilitates removal of the developer mix, as will be apparent.

FIGS. 3 and 4 are presented as examples of other developer station construction and arrangements useful with the present invention. In FIG. 3, flow-mix can be interrupted at generally 53 in order to facilitate mix removal in accordance with the present invention. In FIG. 4, mix-flow can be interrupted at generally 54.

A preferred embodiment of the present invention utilized corrugated fiberboard of 275-pound strength. About 22 pounds of developer mix is contained in a polyethylene double bag, which is sealed with a twist tie. Each bag is 4 mils thick. The two ends of the container are taped shut, using reinforced tape.

Figure 5:
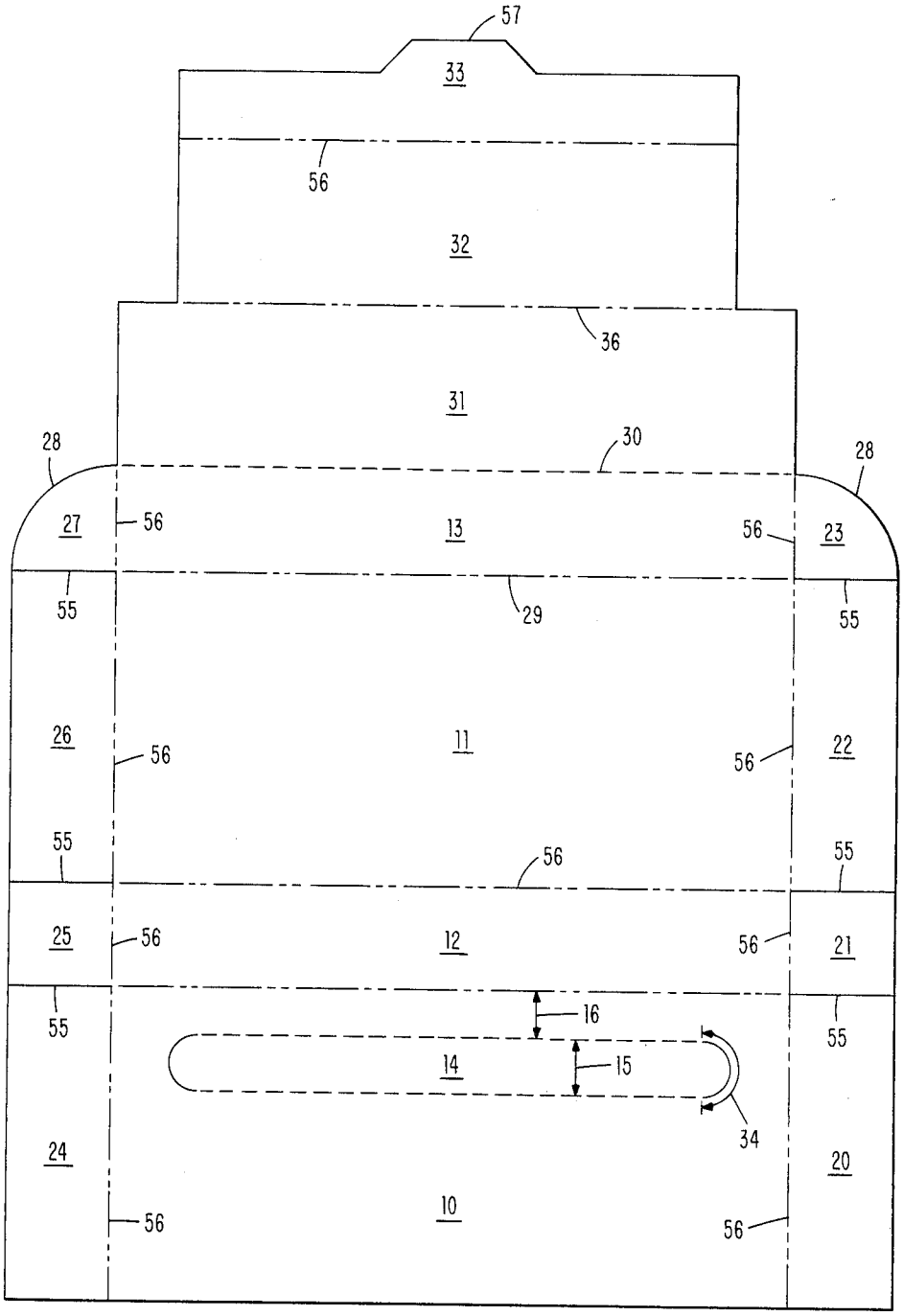
FIG. 5 shows the flat fiberboard piece from which the container of the present invention is formed.

The single piece of fiberboard comprising the container of the present invention is shown in FIG. 5. The two side panels are designated as 10 and 11. The bottom panel is 12, and the top panel is 13.

Panel 10 will face FIG. 1s mix-flow 48. This panel includes a perforated tear strip 14 (zipper perforated, or both sides perforated) of oblong construction, parallel to panel 12. The width 15 of the panel, and its spacing 16 from fold-line 17 is selected to produce optimum loading of the container by mix-flow 48. End portion 34 of the tear-strip is through-cut, in order to enable insertion of a finger, for removal of the tear strip after the container's developer mix content has been removed.

End panels 20–27 are folded and taped in conventional fashion to close the two ends of the container.

Panels 27 and 23 are rounded at 28 to facilitate opening of the top of the container, as panel 13 pivots about score or fold-line 29, in order to enable the sealed bag of developer mix to be removed, prior to use of the container as a customer-engineer-tool. Fold-line 30 is perforated (a perforated score, or single layer perforation), thus allowing the customer engineer to tear off and discard panels 31, 32, 33 prior to use of the empty container as a mix-removal-tool.

Figure 6:
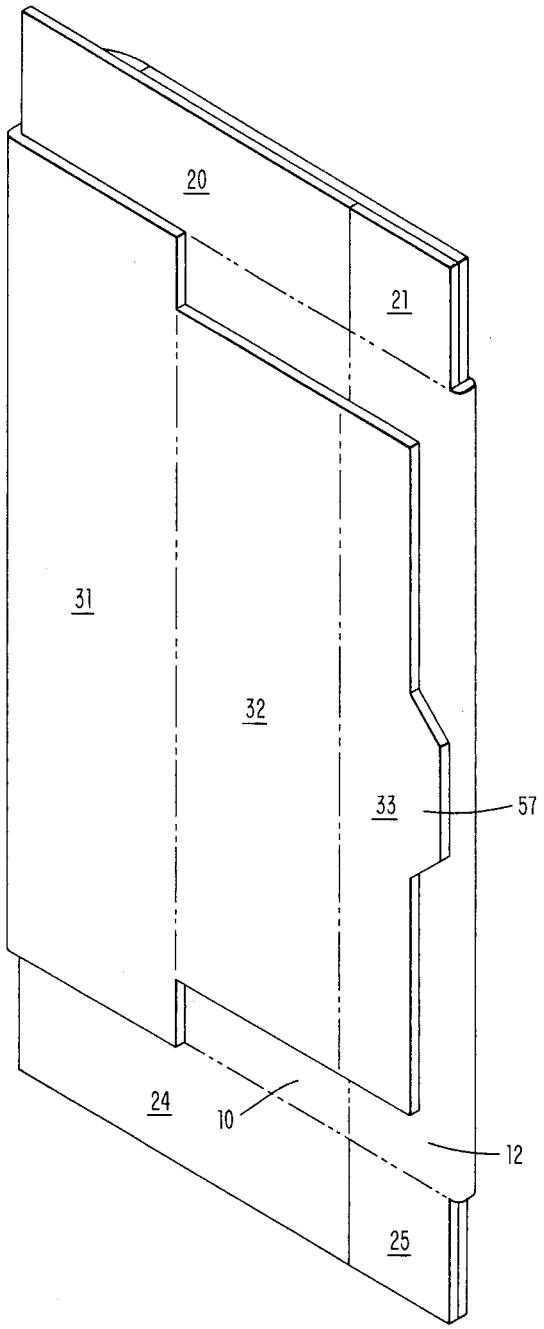
FIG. 6 is a view showing the collapsed state of the present invention's shipping container/mix removal tool.

Panels 31 and 32 overlap panel 10 in the container's assembled state (FIG. 6 for example). Panel 32 is shorter than panel 31, and is separated from panel 31 by fold-line 36. As a result, panel 32 covers and protects tear strip 14, while at the same time leaving a portion of panel 10 available for attachment of sealing tape at both ends of the container. Fold-line 36 is provided for the convenience of the customer engineer, should he desire to fold the open panel assembly 31–33 out of the way during use of the container as a tool.

Numbers 55 designate cut or slot lines, whereas 56 designates further fold lines. All fold lines, with the exception of 30, are scored to facilitate folding, but without cutting the fiberboard.

In order to produce the configuration of FIG. 6, the fiberboard of FIG. 5 is folded at the fold-line separating panels 10–12, 12–11, 11–13, 13–31 and 32–33. Panel 33 covers, and is glued to, panel 12. Finger-tab 57 facilitates opening of the container by the customer engineer.

Figure 7:
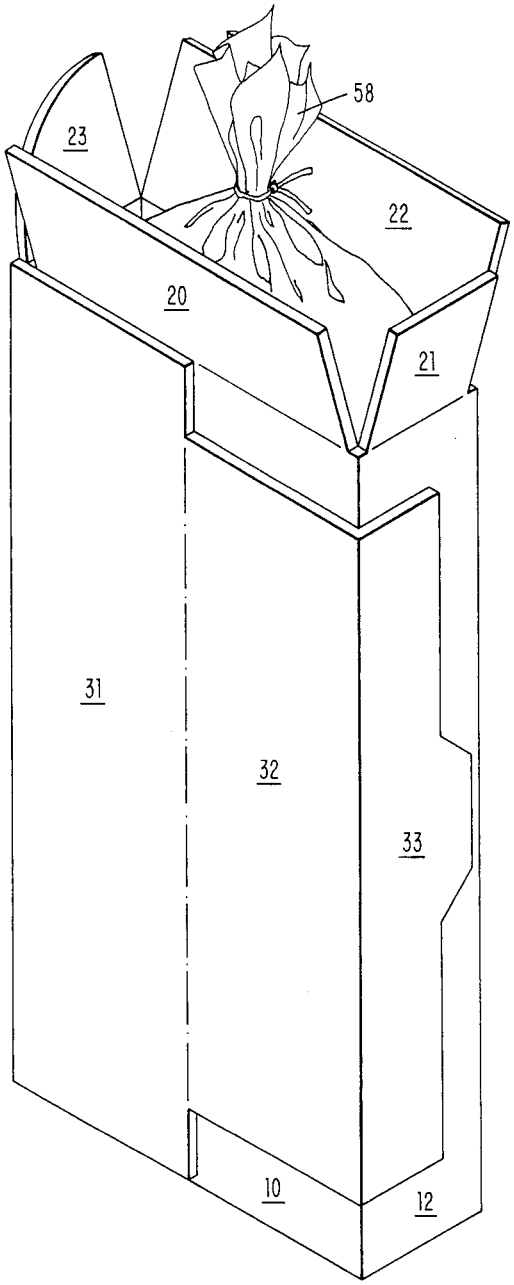
FIG. 7 shows the shipping container in an unfolded or expanded state, with one end of the container secured shut, with a plastic bag inserted into the container to thereby line the container, and the developer mix loaded into the plastic bag, for example at the location of the developer mix manufacturing plant.

In FIG. 7, panels 24, 25, 26 and 27 have been folded (panels 25 and 27 first) and the end has been taped shut. The container now stands on this taped end, as about 22 pounds of developer mix are loaded into plastic bag 58 which has been placed to line the container. After the bag has been filled, it is sealed, and panels 20, 21, 22 and 23 are folded and taped shut.

The container is now ready for storage. Subsequently, the container is shipped to the office location of a xerographic device requiring customer engineer servicing.

Figure 8:
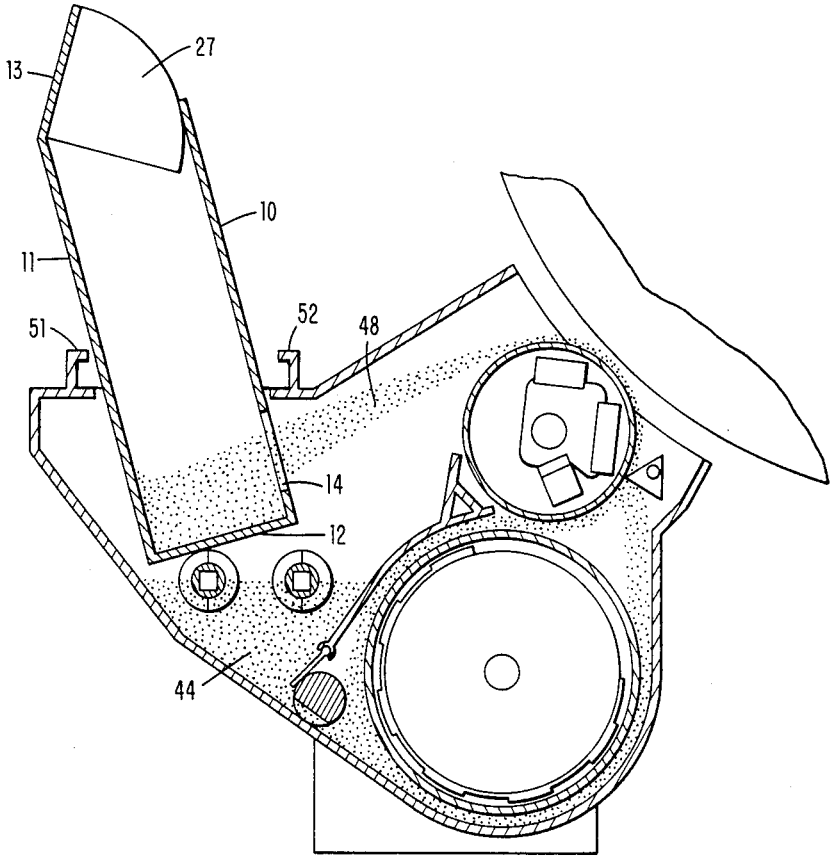
FIG. 8 shows the empty container in position to intercept mix-flow 48 of FIG. 1.

FIG. 8 shows the empty container in position to intercept mix-flow 48 of FIG. 1.

While the invention has been particularly shown and described with reference to preferred embodiments thereof, it will be understood by those skilled in the art that various changes in form and details may be made therein without departing from the spirit and scope of the invention.

What is claimed is:

1. A developer mix shipping container, and service tool, for use with a xerographic developer, comprising:

a closed, hollow polyhedron containing a sealed inner container of developer mix, said polyhedron being configured to fit within the developer of a xerographic device with a known attitude of the polyhedron intercepting the mix-flow path within the developer; and a removable portion formed on a wall surface of said polyhedron, removal of said portion leaving an opening to the cavity of said polyhedron, which opening intercepts the developer mix flow path of said developer, when said polyhedron is positioned in said known attitude;

such that removal of said sealed inner container results in an empty polyhedron which is usable as a service tool to remove old developer mix from said developer, prior to placement of the contents of said sealed container within said developer.

2. The arrangement of claim 1 wherein said polyhedron is a rigid-wall rectangular prism having a major axis, said sealed inner container is a flexible pouch which conforms to the shape of said rectangular prism while contained within the same, and wherein said portion is a tear strip which is elongated in a direction generally parallel to said major axis.

3. The arrangement of claim 2 wherein said rectangular prism includes an openable wall disposed above said tear strip to facilitate removal of said plastic pouch.

4. The arrangement of claim 3 wherein said openable wall includes an external portion which overlaps, strengthens and protects said tear strip prior to opening of the shipping container and removal of the pouch.

5. The arrangement of claim 4 wherein said shipping container is formed of a single piece of corrugated fiberboard, and the pouch is formed of plastic.

6. The arrangement of claim 5 wherein said fiberboard is thru-cut at a portion of said tear strip which is protected by said openable wall overlap, to thereby facilitate manual removal of said tear strip.

7. A method for removing used developer mix from a xerographic developer, and replacing the used mix with new mix, comprising the steps of:

packaging said new mix in an inner container which is protected for shipment by a combined overpack and mix removal tool, said overpack having a manually removable portion thereof which, when removed, exposes the interior cavity of said overpack;

opening an exterior surface of said xerographic developer in order to expose a portion of the mix-flow path of said developer;

removing said inner container from said overpack;

removing said portion from said overpack to thereby leave an opening;

inserting the now-empty overpack into said xerographic developer, in a position such that said opening intercepts said mix-flow path;

operating said developer to thereby cause the developer's used mix to pass through said opening as it enters the cavity of said overpack;

removing said overpack from within said xerographic developer;

placing the contents of said inner container within said xerographic developer; and closing said developer's exterior surface.

8. The method of claim 7 wherein said inner package is a sealed, nonrigid bag, and wherein said combined overpack and mix removal tool is formed of a disposable shipping material such as paperboard.

9. The method of claim 8 including the step of disposing of the now-empty inner container, and said overpack and its content of used developer mix.

* * * * *